US009221635B2

(12) United States Patent
Kosuga

(10) Patent No.: US 9,221,635 B2
(45) Date of Patent: Dec. 29, 2015

(54) SHEET FEEDING APPARATUS AND IMAGE FORMING APPARATUS

(75) Inventor: Kazuhiro Kosuga, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/117,102

(22) PCT Filed: Jun. 25, 2012

(86) PCT No.: PCT/JP2012/004092
§ 371 (c)(1),
(2), (4) Date: Nov. 12, 2013

(87) PCT Pub. No.: WO2012/176478
PCT Pub. Date: Dec. 27, 2012

(65) Prior Publication Data

US 2015/0001786 A1 Jan. 1, 2015

(30) Foreign Application Priority Data

Jun. 24, 2011 (JP) ..... 2011-140346

(51) Int. Cl.
*B65H 1/18* (2006.01)
*B65H 3/06* (2006.01)
(Continued)

(52) U.S. Cl.
CPC .. *B65H 7/02* (2013.01); *B65H 1/14* (2013.01); *B65H 1/18* (2013.01); *B65H 1/24* (2013.01);
(Continued)

(58) Field of Classification Search
CPC ..... B65H 3/06; B65H 3/0684; B65H 1/14; B65H 1/18
USPC ..... 271/117, 126, 127, 113, 121
See application file for complete search history.

(56) References Cited

U.S. PATENT DOCUMENTS 6,161,829 A 12/2000 Kusumi
6,578,842 B2 6/2003 Hoberock
(Continued)

FOREIGN PATENT DOCUMENTS

CN 1226506 A 8/1999
CN 1097013 C 12/2002
(Continued)

OTHER PUBLICATIONS

Japanese Office Action issued in corresponding Japanese Patent Application No. 10091210JP01 dated Apr. 21, 2015.
(Continued)

*Primary Examiner* — Luis A Gonzalez
(74) *Attorney, Agent, or Firm* — Fitzpatrick, Cella, Harper & Scinto

(57) ABSTRACT

A sheet feeding roller 101 which feeds a sheet stacked on a sheet supporting plate 110 capable of being lifted and lowered is supported by a support portion as being linearly movable in an up-and-down direction, and a roller biasing member applies a force to the support portion in a direction in which the sheet feeding roller is pressed to s sheet stacked on the sheet supporting plate. A biasing direction 101*b* of the sheet feeding roller due to the roller biasing member is set within a range between a normal line of the sheet feeding roller at the upstreammost pressing position against the sheet feeding direction and a normal line of the sheet feeding roller at the downstreammost pressing position out of the pressing positions where the sheet feeding roller is pressed to the sheet as being varied in accordance with a sheet stacking state of the sheets.

10 Claims, 12 Drawing Sheets

(51) Int. Cl.

| | |
|---|---|
| ***B65H 7/02*** | (2006.01) |
| ***B65H 1/14*** | (2006.01) |
| ***B65H 1/24*** | (2006.01) |
| ***B65H 5/06*** | (2006.01) |
| ***B65H 7/20*** | (2006.01) |

(52) U.S. Cl.

CPC ..... *B65H 3/06* (2013.01); *B65H 3/0607* (2013.01); *B65H 3/0684* (2013.01); *B65H 5/068* (2013.01); *B65H 7/20* (2013.01); *B65H 2404/152* (2013.01); *B65H 2405/1117* (2013.01)

(56) References Cited

U.S. PATENT DOCUMENTS

| | | | | |
|---|---|---|---|---|
| 6,764,071 | B2 | 7/2004 | Hoberock | |
| 7,055,818 | B2 | 6/2006 | Furusawa | |
| 7,654,517 | B2 * | 2/2010 | Oshima | 271/152 |
| 8,083,231 | B2 | 12/2011 | Hirata et al. | |
| 8,419,008 | B2 | 4/2013 | Ikeda et al. | |
| 8,651,477 | B2 * | 2/2014 | Chiba | 271/152 |
| 2003/0001334 | A1 | 1/2003 | Hoberock | |
| 2003/0193126 | A1 | 10/2003 | Hoberock | |
| 2010/0096795 | A1 | 4/2010 | Bober et al. | |
| 2012/0080838 | A1 | 4/2012 | Osada et al. | |
| 2012/0326381 | A1 * | 12/2012 | Inoue | 271/117 |
| 2012/0326382 | A1 * | 12/2012 | Hayayumi | 271/117 |

FOREIGN PATENT DOCUMENTS

| | | | | |
|---|---|---|---|---|
| JP | 59092838 | A | * | 5/1984 |
| JP | 61235331 | A | * | 10/1986 |
| JP | 07-242347 | A | | 9/1995 |
| JP | 11-1301870 | A | | 11/1999 |
| JP | 2002-012330 | | | 1/2002 |
| JP | 3463915 | B2 | | 11/2003 |
| JP | 2009-007086 | A | | 1/2009 |

OTHER PUBLICATIONS

Chinese Office Action issued in Corresponding Chinese Application No. 201280030084.2 dated Feb. 16, 2015.

* cited by examiner

SHEET FEEDING APPARATUS AND IMAGE FORMING APPARATUS

BACKGROUND OF THE INVENTION

1. Field of the Invention

The present invention relates to a sheet feeding apparatus and an image forming apparatus, and in particular, relates to a structure to apply a downward force to a feeding roller which feeds a sheet stacked on a sheet stack tray.

2. Description of the Related Art

Conventionally, an image forming apparatus such as a printer and a copying machine is provided with a sheet feeding apparatus including a sheet feeding cassette being a sheet storage portion in which sheets are stacked and a feeding portion which feeds sheets stacked in the sheet feeding cassette as separating one by one. An example of such a sheet feeding apparatus includes a feeding roller which feeds sheets and a separation roller which separates sheets as being abutted to the feeding roller. Further, in the sheet feeding cassette, a sheet stack tray on which sheets are stacked is arranged movably in an up-and-down direction and a sheet feeding force is generated by pressing the sheets to the feeding roller as applying a force to the sheet stack tray with a spring.

Then, the feeding roller is rotated as being pressed to an uppermost sheet stacked on the sheet stack tray to feed a sheet, so that the uppermost sheet is to be fed. Subsequently, the sheet is separated one by one while the fed uppermost sheet passes through a nip of the feeding roller and a separation roller to which a torque limiter to be pressed to the feeding roller is coaxially arranged. Here, the sheet separated one by one is fed to a conveying path toward an image forming portion (see Japanese Patent Laid-Open No. 2009-007086).

By the way, recently, it has been desired to increase an amount (the number) of sheets which can be stored in a sheet feeding cassette to reduce sheet replenishment frequency. However, with a structure to push up a sheet stack tray with a spring toward a sheet feeding roller, following problems occur. Here, large-sized sheets and small-sized sheets are different in weight. In a case that the number of sheets to be stacked on the sheet stack tray is increased, the weight difference between large-sized sheets and small-sized sheets becomes large at the time of being fully-stacked.

In a case that the spring is set for sheet feeding pressure (pressure of the sheet feeding roller abutting to a sheet upper face) of small-sized sheets, sheet non-feeding occurs as the sheet feeding pressure of the sheet feeding roller becomes smaller owing to the fact that sheet weight becomes larger when large-sized sheets are to be fed. In a case that the spring force is set large as corresponding to large-sized sheets, double-feeding occurs as the sheet feeding pressure becomes excessively large as a result of excessively large pressing force when small-sized sheets are stored.

Further, variation of the sheet feeding pressure is largely influenced by a density and a basis weight of sheets as well as a sheet size. For example, a density of certain sheet type could be twice or more than that of a different type. Further, there is a case that densities of sheets having the same size could differ on the order of 30%. Variation of the sheet feeding pressure owing to the density difference is large with increase of the number of stacked sheets.

In the conventional sheet feeding apparatus described above, it is possible to adjust sheet feeding pressure in accordance with sheet size. However, the sheet feeding pressure cannot be adjusted in accordance with density and basis weight of sheets. Accordingly, as the number of sheet types which can be supported by an image forming apparatus is increased, it becomes more difficult to satisfy both sheet feeding performance and enlarging of sheet stacking capacity.

To address the above issues, the present invention provides a sheet feeding apparatus and an image forming apparatus capable of stably performing sheet feeding even in a case that sheet stacking capacity is enlarged.

SUMMARY OF THE INVENTION

According to the present invention, there is provided a sheet feeding apparatus, including: a sheet storage portion which includes the sheet stack tray being swingable in an up-and-down direction; a feeding roller which is arranged above the sheet stack tray and which feeds an uppermost sheet stacked on the sheet stack tray; a support portion which supports the feeding roller as being linearly movable in the up-and-down direction; a roller biasing member which applies a force to the feeding roller in a direction of pressing to the sheet stacked on the sheet stack tray; and a separation member which is pressed to the sheet feeding roller to structures a separation portion with the sheet feeding roller that separates the sheets in to single sheet.

In the present invention, the feeding roller is supported as being linearly movable in an up-and-down direction and is applied a force in a direction to be pressed to a sheet stacked on the sheet stack tray. Accordingly, sheets can be stably fed even when sheet stacking capacity is enlarged.

Further features of the present invention will become apparent from the following description of exemplary embodiments with reference to the attached drawings.

DESCRIPTION OF THE EMBODIMENTS

Figure 1:
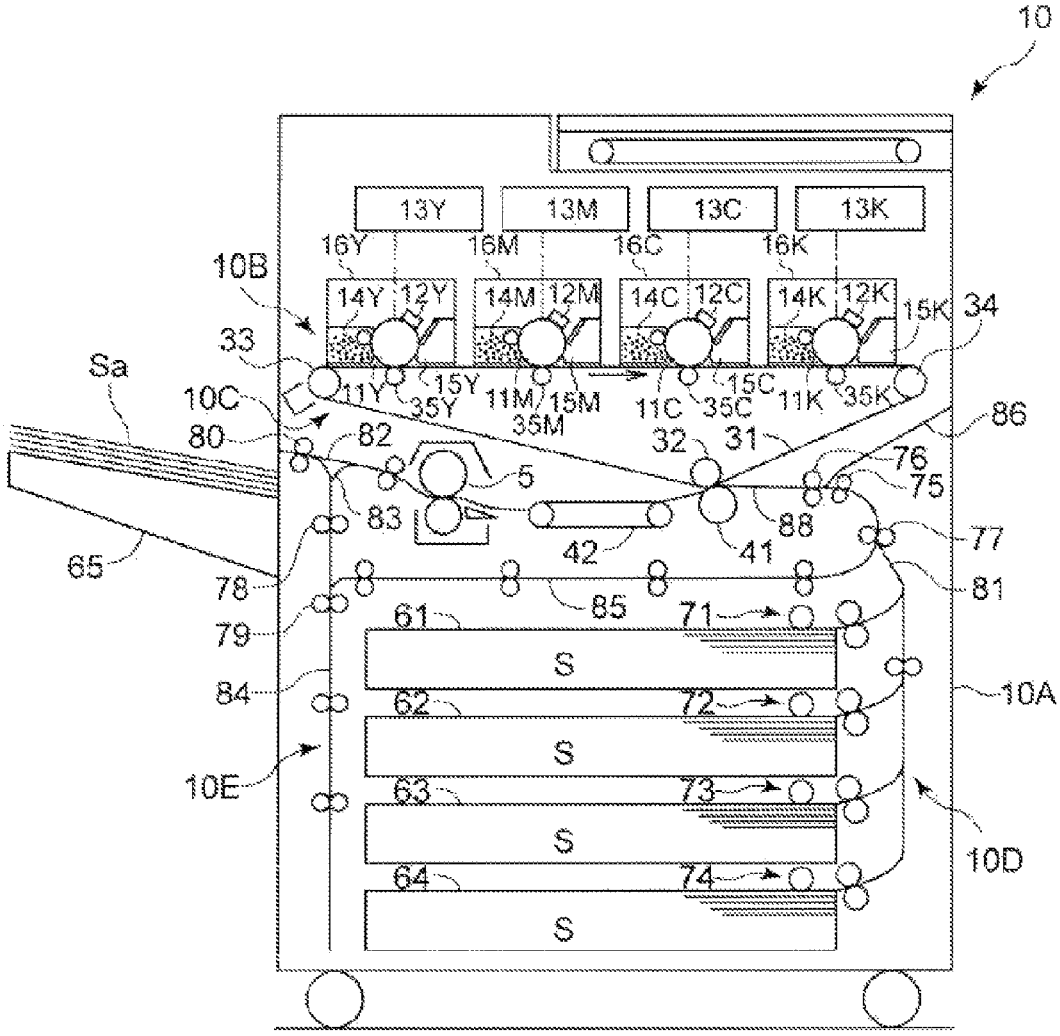
FIG. 1 is a view illustrating a schematic structure of a color laser beam printer which is an example of an image forming apparatus according to a first embodiment of the present invention.

In the following, embodiments of the present invention will be described in detail with reference to the drawings. FIG. 1 is a view illustrating a schematic structure of a color laser beam printer which is an example of an image forming apparatus including a sheet feeding apparatus according to a first embodiment of the present invention. FIG. 1 illustrates a color laser beam printer 10 and a color laser beam printer main body (hereinafter, referred to as a printer main body) 10A. The printer main body 10A includes an image forming portion 10B which forms an image on a sheet S, an intermediate transfer portion 10C, a fixing apparatus 5, and a sheet feeding portion 10D which feeds a sheet S to the image forming portion 10B. Here, the color laser beam printer 10 is capable of forming an image at a back face of a sheet S as being provided with a re-conveying portion 10E which conveys the sheet S again to the image forming portion 10B after reversing the sheet S which has an image formed at a front face (one face) thereof.

The image forming portion 10B includes four process stations 16 (16Y, 16M, 16C, and 16K) which are arranged in a substantially horizontal direction and which respectively form toner images of four colors being yellow (Y), magenta (M), cyan (C) and black (Bk). The process stations 16 respectively bear toner images of four colors being yellow, magenta, cyan and black and include photosensitive drums 11 (11Y, 11M, 11C, and 11K) which are image bearing members to be driven by a stepping motor (not illustrated).

The image forming portion 10B also includes charging units 12 (12Y, 12M, 12C, and 12K) which evenly charge photosensitive drum surfaces. Further, the image forming portion 10B includes exposing units 13 (13Y, 13M, 13C, and 13K) which form an electrostatic latent image on each photosensitive drum rotating at a constant speed by irradiating laser beams based on image information. Furthermore, the image forming portion 10B includes developing units 14 (14Y, 14M, 14C, and 14K) which perform visualization as toner images by sticking toner of yellow, magenta, cyan and black to the electrostatic latent images formed on the photosensitive drums. The charging units 12, the exposing units 13 and the developing units 14 are arranged respectively at the circumference of the photosensitive drums 11 along the rotation direction.

The sheet feeding portion 10D includes sheet feeding apparatuses 71 to 74 which feed sheets S stacked and stored in sheet feeding cassettes 61 to 64 respectively, which are arranged at a lower part of the printer main body 10A and serve as sheet storage portions to store sheets S. When image forming operation is started, a sheet S is separated and fed one by one from each of the sheet feeding cassettes 61 to 64 by the sheet feeding apparatus 71 to 74. Subsequently, the sheet S separated and fed one by one passes through a vertical conveying path 81 and arrives at a horizontal conveying path 88, and then, is conveyed to a registration roller 76 arranged at the horizontal conveying path 88.

Here, the registration roller 76 has a function to correct skew feeding by forming a loop while a sheet S is struck to make the top end of the sheet S follow thereto. Further, the registration roller 76 has a function to convey the sheet S to a secondary transfer portion at timing of image forming onto the sheet S, that is, at predetermined timing in harmony with a toner image borne on a later-mentioned intermediate transfer belt. Here, when the sheet S is to be conveyed, the registration roller 76 remains stopped. The sheet S is struck to the registration roller 76 in such a stopped state, so that deformation is formed at the sheet S. Subsequently, skew feeding of the sheet S is corrected as the top end of the sheet S being flush with nipping of the registration roller 76 owing to stiffness of the sheet S.

The intermediate transfer portion 10C includes an intermediate transfer belt 31 which is rotationally driven in the arrangement direction of the respective process stations 16 as illustrated by an arrow in synchronization with outer circumferential velocity of the photosensitive drums 11. Here, the intermediate transfer belt 31 is tensionally hanged over a drive roller 33, a driven roller 32 which forms a secondary transfer range as nipping the intermediate transfer belt 31, and a tension roller 34 which applies an appropriate tensional force to the intermediate transfer belt 31 with a biasing force of a spring (not illustrated).

Four primary transfer rollers 35 (35Y, 35M, 35C, and 35K) which respectively structure a primary transfer portion are arranged at the inside of the intermediate transfer belt 31 as nipping the intermediate transfer belt 31 with the respective photosensitive drums 11. Here, the primary transfer rollers 35 are connected to a power supply for transfer biasing (not illustrated). When transfer bias is applied from the primary transfer roller 35 to the intermediate transfer belt 31, the toner images of the respective colors on the photosensitive drums 11 are sequentially transferred to the intermediate transfer belt 31 in a multi-layered manner, so that a full-color image is formed on the intermediate transfer belt 31.

Further, a secondary transfer roller 41 is arranged to be opposed to the driven roller 32. The secondary transfer roller 41 nips and conveys a sheet S which has been conveyed by the registration roller 76 with the intermediate transfer belt 31 as being abutted to a lowermost surface of the intermediate transfer belt 31. Then, bias is applied to the secondary transfer roller 41 when the sheet S passes through a nip portion of the secondary transfer roller 41 and the intermediate transfer belt 31, so that the toner image on the intermediate transfer belt 31 is secondarily transferred to the sheet S. The fixing apparatus 5 is to fix the toner image formed on the sheet S via the intermediate transfer belt 31 on the sheet S. The toner image is fixed by applying heat and pressure to the sheet S bearing the toner image when passing through the fixing apparatus 5.

Next, image forming operation of the color laser beam printer 10 as structured above will be described. When the image forming operation is started, laser irradiation is performed by the exposing unit 13Y to the photosensitive drum 11Y firstly at the process station 16Y which is located at the upstreammost side in the rotation direction of the intermediate transfer belt 31, and thereby a latent image of yellow is formed on the photosensitive drum 11Y. Subsequently, a yellow toner image is formed by developing the latent image with yellow toner at the developing unit 14Y. Then, the yellow toner image formed on the photosensitive drum 11Y as described above is primarily transferred to the intermediate transfer belt at the primary transfer range by the primary transfer roller 35Y to which high voltage is applied.

Subsequently, the toner image is conveyed along with the intermediate transfer belt 31 to the primary transfer range which is structured with the photosensitive drum 11M and the transfer roller 35M of the next process station 16M at which an image is to be formed as being delayed from the process station 16Y by the time of conveying the toner image. Then, the next magenta toner image is transferred onto the yellow toner image on the intermediate transfer belt 31 as the image top ends being matched. Subsequently, the similar process is repeated. As a result, toner images of four colors are primarily transferred onto the intermediate transfer belt 31, so that the full-color image is formed on the intermediate transfer belt. Here, residual transfer toner slightly remained on the photosensitive drum 11 is recovered respectively by a photosensitive drum cleaner 15 (15Y, 15M, 15C, or 15K) to be prepared again for the next image forming.

Further, a sheet S stored in each of the sheet feeding cassettes 61 to 64 is separated and fed one by one by the sheet feeding apparatus 71 to 74 in parallel to the toner image forming operation, and then, is conveyed to the registration roller 76 via a conveying roller 77. At that time, the registration roller 76 remains stopped and the sheet S is struck to the registration roller 76 in a stopped state, so that skew feeding of the sheet S is corrected. After skew feeding is corrected, the sheet S is conveyed to the nip portion of the secondary transfer roller 41 and the intermediate transfer belt 31 by the registration roller 76 starting to be rotated at timing at which the sheet top end and the toner image formed on the intermediate transfer belt 31 are matched. Subsequently, when the sheet S passes through the nip portion of the secondary transfer roller 41 and the intermediate transfer belt 31 as being nipped and conveyed by the secondary transfer roller 41 and the intermediate transfer belt 31, the toner image on the intermediate transfer belt 31 is secondarily transferred to the sheet S with bias applied to the secondary transfer roller 41.

Subsequently, the sheet S to which the toner image is secondarily transferred is conveyed to the fixing apparatus 5 by a pre-fixing conveying unit 42. Then, the toner image is melted and fixed on the sheet S by applying a predetermined pressing force due to an opposed roller or a belt and a heating effect due to a heat source such as a heater in general. Here, the present color laser beam printer 10 has a single mode in which image forming is performed on one face of a sheet S and a duplex mode in which image forming is performed on both front and back faces of a sheet S. Then, route selection is performed by a switching member (not illustrated) so as to convey a sheet S having a fixed image to a discharge conveying path 82 in the single mode and to a reverse guide path 83 in the duplex mode.

In the single mode, the sheet S having the fixed image is discharged to a discharge tray 65 by a discharge roller 80 via the discharge conveying path 82. In the duplex mode, the sheet S is drawn into a switch-back path 84 by a first pair of reverse rollers 78 and a second pair of reverse rollers 79 via the reverse guide path 83. Then, the sheet S is conveyed to a duplex convey path 85 in a state where top and back ends are reversed with switch-back operation due to forward-backward rotation of the second pair of reverse rollers 79.

Subsequently, the sheet S conveyed through the duplex conveying path 85 is merged with the vertical conveying path 81 in timing as being matched with a sheet S for a subsequent job conveyed by the sheet feeding apparatus 71 to 74. The sheet S is then similarly fed from the horizontal conveying path 88 to the secondary transfer portion via the registration roller 76. Here, a subsequent image forming process for the back face (second face) is similar to the abovementioned process for the front face (first face).

Figure 2:
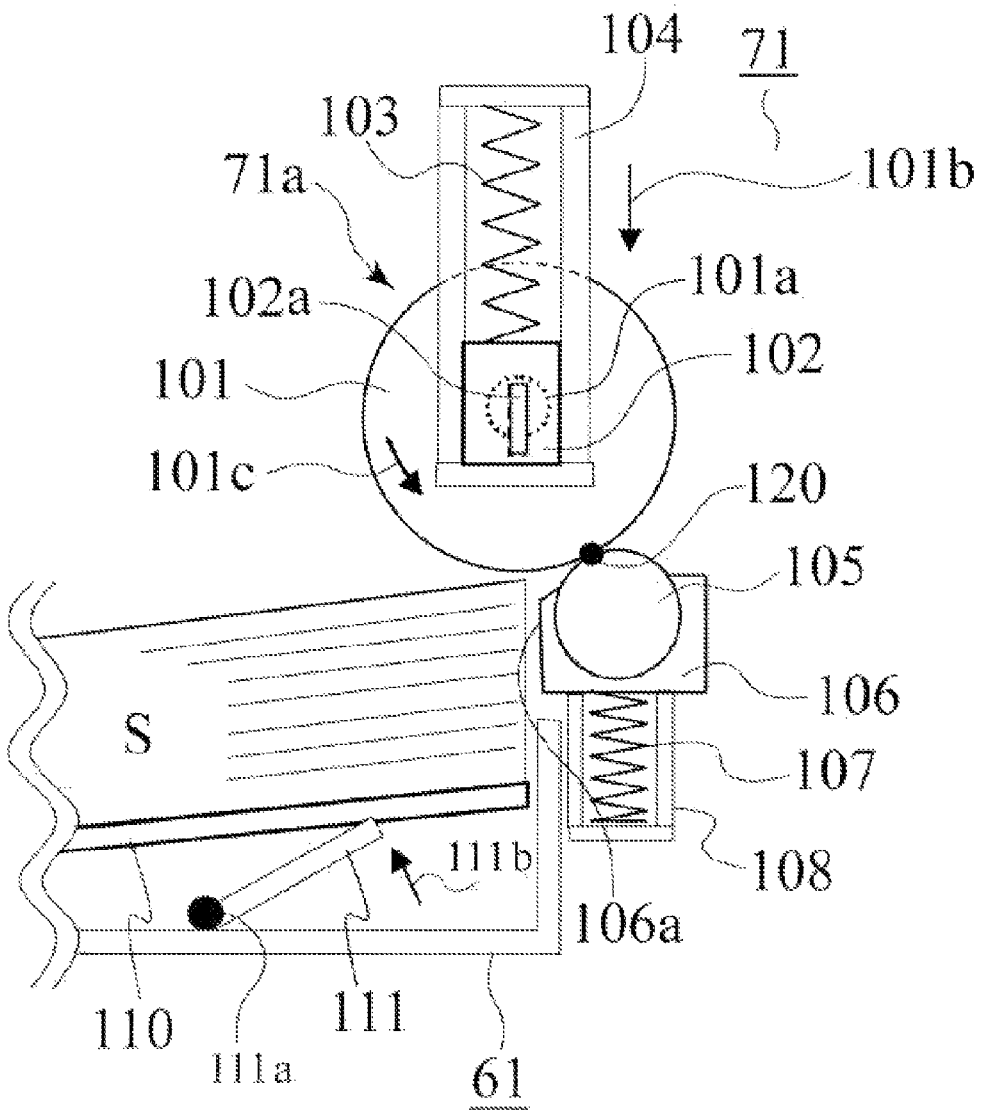
FIG. 2 is an explanatory view of a structure of a sheet feeding apparatus of the color laser beam printer.

FIG. 2 is a view illustrating a structure of the sheet feeding apparatus 71. Here, other sheet feeding apparatuses 72 to 74 are similarly structured. The sheet feeding apparatus 71 is provided with the sheet feeding cassette 61 which is a sheet storage portion to be attached in a detachably attachable manner to the printer main body 10A also serving as a sheet feeding apparatus main body and which has a sheet supporting plate 110 being a sheet stack tray on which sheets S are stacked as being capable of lifting and lowering (swingable in the up-and-down direction). Further, the sheet feeding apparatus 71 is arranged above the sheet supporting plate 110 movably in the up-and-down direction and is provided with a sheet feeding roller 101 being a feeding roller which feeds a sheet S stacked on the sheet supporting plate 110.

Here, FIG. 2 illustrates a separation roller 105 being a separation member which separates sheets fed by the sheet feeding roller 101. The separation roller 105 is pressed to the sheet feeding roller 101 as being capable of being contacted to and separated from thereto. Then, a separation portion which performs feeding of sheets while separating them into a single sheet is structured with the separation roller 105 and the sheet feeding roller 101.

The sheet supporting plate 110 is swung in the up-and-down direction about a fulcrum (not illustrated) by a lifter 111 which is swung in the up-and-down direction about a lifter shaft 111*a* owing to a lifting and lowering mechanism which is structured with a later-mentioned lifter motor 140 illustrated in FIG. 4 and a drive gear (not illustrated). Here, when performing sheet feeding, the lifter 111 is upwardly swung and the sheet supporting plate 110 is lifted. When the sheet feeding cassette 61 is drawn, the sheet supporting plate 110 is lowered owing to its own weight or sheet load as being integral with the lifter 111 in synchronization with drawing operation of the sheet feeding cassette 61. Further, when height of the uppermost sheet becomes low as feeding the sheets S, the lifter motor 140 is driven and the sheet supporting plate 110 is lifted so that the height of the uppermost sheet reaches the height where sheet feeding can be performed.

The sheet feeding roller 101 is supported in a swingable manner by a sheet feeding roller bearing 102 via the sheet feeding roller shaft 101*a*. The sheet feeding roller bearing 102 is supported as being slidable upwardly and downwardly by a sheet feeding roller restricting guide 104 which is arranged along the up-and-down direction in a state of being applied a force substantially downwardly as illustrated by arrow 101*b* by a sheet feeding roller pressing spring 103 being a roller biasing member. That is, in the present embodiment, the sheet feeding roller 101 is supported by the sheet feeding roller restricting guide 104 as being linearly slidable upwardly and downwardly in a state of being pressed substantially downwardly by the sheet feeding roller pressing spring 103 via the sheet feeding roller bearing 102. Here, in the present embodiment, the sheet feeding roller bearing 102 and the sheet feeding roller restricting guide 104 structure a support portion 71*a* which supports the sheet feeding roller 101 as being linearly movable in the up-and-down direction.

Figure 3:
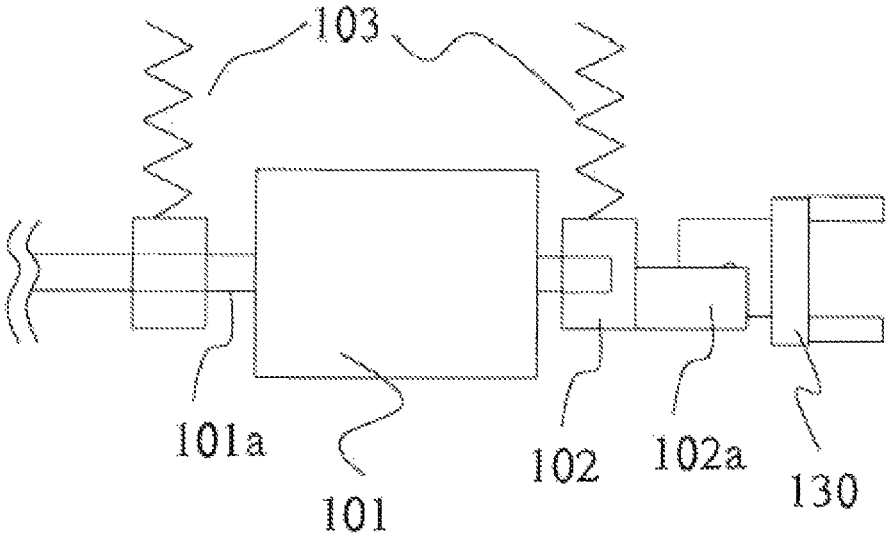
FIG. 3 is an explanatory view of a structure of a sheet feeding roller position detecting sensor which detects a position of a sheet feeding roller arranged in the sheet feeding apparatus.

With the above structure, when sheets are sequentially fed as described later, the sheet feeding roller 101 is gradually lowered while being abutted to a sheet as being integral with the sheet feeding roller bearing 102 which is applied a force by the sheet feeding roller pressing spring 103. Here, the sheet feeding roller bearing 102 is provided with a projecting portion 102*a*. Further, as illustrated in FIG. 3, the printer main body 10A is provided with a sheet feeding roller position detecting sensor 130 being a sensor portion which detects the projecting portion 102*a* being a sensor lever. When the sheet feeding roller 101 is lowered by a predetermined amount, the sheet feeding roller position detecting sensor 130 detects the projecting portion 102*a*.

Figure 4:
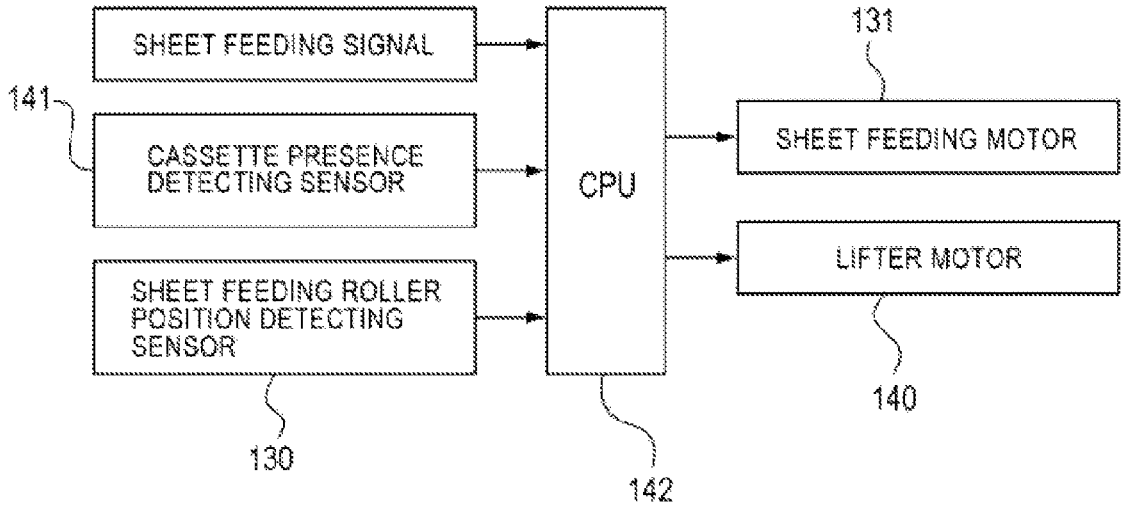
FIG. 4 is a control block diagram of the sheet feeding apparatus.

Then, as illustrated in FIG. 4, a detection signal of the sheet feeding roller position detecting sensor 130 is input to a CPU 142 which controls sheet feeding operation of the sheet feeding apparatus 71. Here, the CPU 142 is connected with a sheet feeding motor 131 which drives the sheet feeding roller 101 in addition to the sheet feeding roller position detecting sensor 130 and the abovementioned lifter motor 140. Further, the CPU 142 is connected with a cassette presence detecting sensor 141 which detects whether a cassette is loaded to the printer main body 10A. Further, a sheet feeding signal to start sheet feeding operation is input from an external PC (not illustrated).

Then, owing to that fact that a position of the sheet feeding roller 101 is detected, the CPU 142 drives the lifter motor 140 for a predetermined period of time when a detection signal is input from the sheet feeding roller position detecting sensor 130 being a sheet face detecting portion which detects a height of an uppermost sheet stacked on the sheet supporting plate 110. Accordingly, the sheet supporting plate 110 is lifted and the sheet feeding roller 101 is pressed to the sheet S by the sheet feeding roller pressing spring 103 owing to the lifting of the sheet supporting plate 110. Thus, the pressing force enabling to perform sheet feeding is applied to the sheet S.

Further, the separation roller 105 arranged below the sheet feeding roller 101 incorporates a torque limiter (not illustrated). The separation roller 105 is obsequiously rotated with a rotation force of the sheet feeding roller 101 and is maintained to be obsequiously rotated when only one sheet S is fed to a separation nip 120. When two or more sheets S are fed, obsequious rotation of the separation roller 105 is stopped by the torque limiter. With the above, only the sheet slidingly contacted to the sheet feeding roller 101 is fed and the rest of the sheets are stopped at the separation nip 120 by the separation roller 105. Here, the present embodiment adopts the separation roller with the torque limiter. However, separation means using a friction pad instead of this structure may be adopted.

Here, the separation roller 105 is held as being movable in the up-and-down direction by a separation guide 106 illustrated in FIG. 2 via a separation roller shaft (not illustrated) and is pressed to the sheet feeding roller 101 by a separation roller pressing spring 107. The separation guide 106 is held as being linearly slidable by a separation roller restricting guide 108 which is fixed to the printer main body 10A. That is, the separation roller 105 is held by the printer main body 10A as being linearly slidable via the separation roller restricting guide 108.

Here, since the separation roller pressing spring 107 applies an approximately upward force to the separation guide 106, the separation roller 105 forms the separation nip 120 against the sheet feeding roller 101 as being pressed to the sheet feeding roller 101. The elastic force of the sheet feeding roller pressing spring 103 is set to be larger than the elastic force of the separation roller pressing spring 107. Accordingly, when the position of the uppermost sheet becomes low as the sheets are sequentially fed as described later, the sheet feeding roller 101 can be lowered as depressing the separation roller 105.

Figure 5:
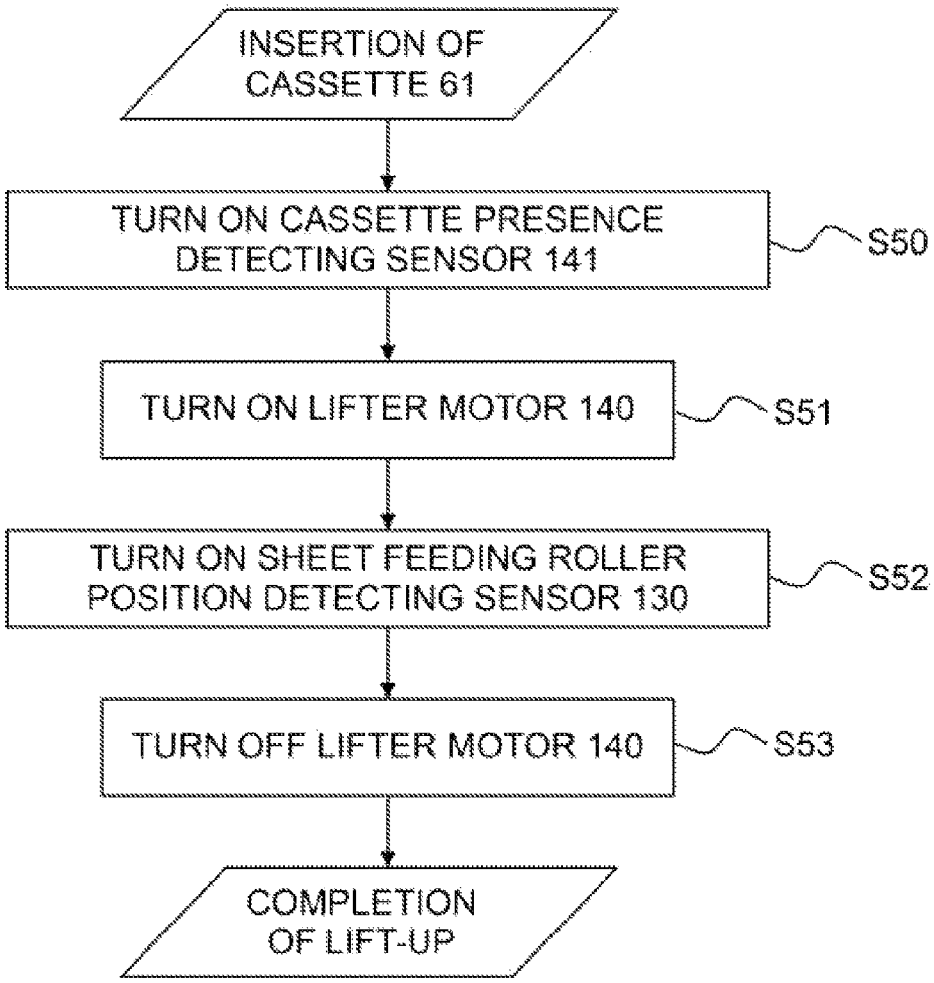
FIG. 5 is a flowchart which describes lift-up control to lift sheets after a cassette of the sheet feeding apparatus is inserted to a printer main body.

Next, description will be performed on lift-up control of the above-structured sheet feeding apparatus 71 to lift the sheets S after the sheet feeding cassette 61 is inserted to the printer main body 10A with reference to a flowchart of FIG. 5.

When the sheet feeding cassette 61 having the sheets S stacked is inserted to the printer main body 10A, the cassette presence detecting sensor 141 is turned ON (S50) and driving of the lifter motor 140 is started (turned ON) (S51) by the CPU 142 being a controller. Then, the driving force of the lifter motor 140 is transmitted to the lifter 111 via a drive gear (not illustrated) to upwardly swing the sheet supporting plate 110 on which the sheets S are stacked. In this manner, lift-up of the sheets S is performed.

Subsequently, the uppermost sheet S is abutted to the sheet feeding roller 101. Here, as described above, as being pressed substantially downwardly by the sheet feeding roller pressing spring 103, the sheet feeding roller 101 is located at the lowermost point of the slidable range as illustrated in FIG. 2 when the sheet S is not abutted thereto.

With the above, after the sheet S is abutted, the sheet feeding roller 101 is lifted against the pressing force of the sheet feeding roller pressing spring 103. When the sheet feeding roller 101 is lifted, the sheet feeding roller position sensor detecting sensor 130 is turned ON as the projecting portion 102*a* (S52) is detected as illustrated in FIG. 3.

Here, when the sheet feeding roller position detecting sensor 130 is turned On and a predetermined period of time passes thereafter, the CPU 142 stops driving of the lifter motor 140 (turned OFF) (S53). In this manner, initial lift-up is completed. Here, when the lift-up is completed as described above, the sheet feeding roller 101 applies a pressing force enabling to perform sheet feeding to the sheet S with the sheet feeding roller pressing spring 103.

Figure 6:
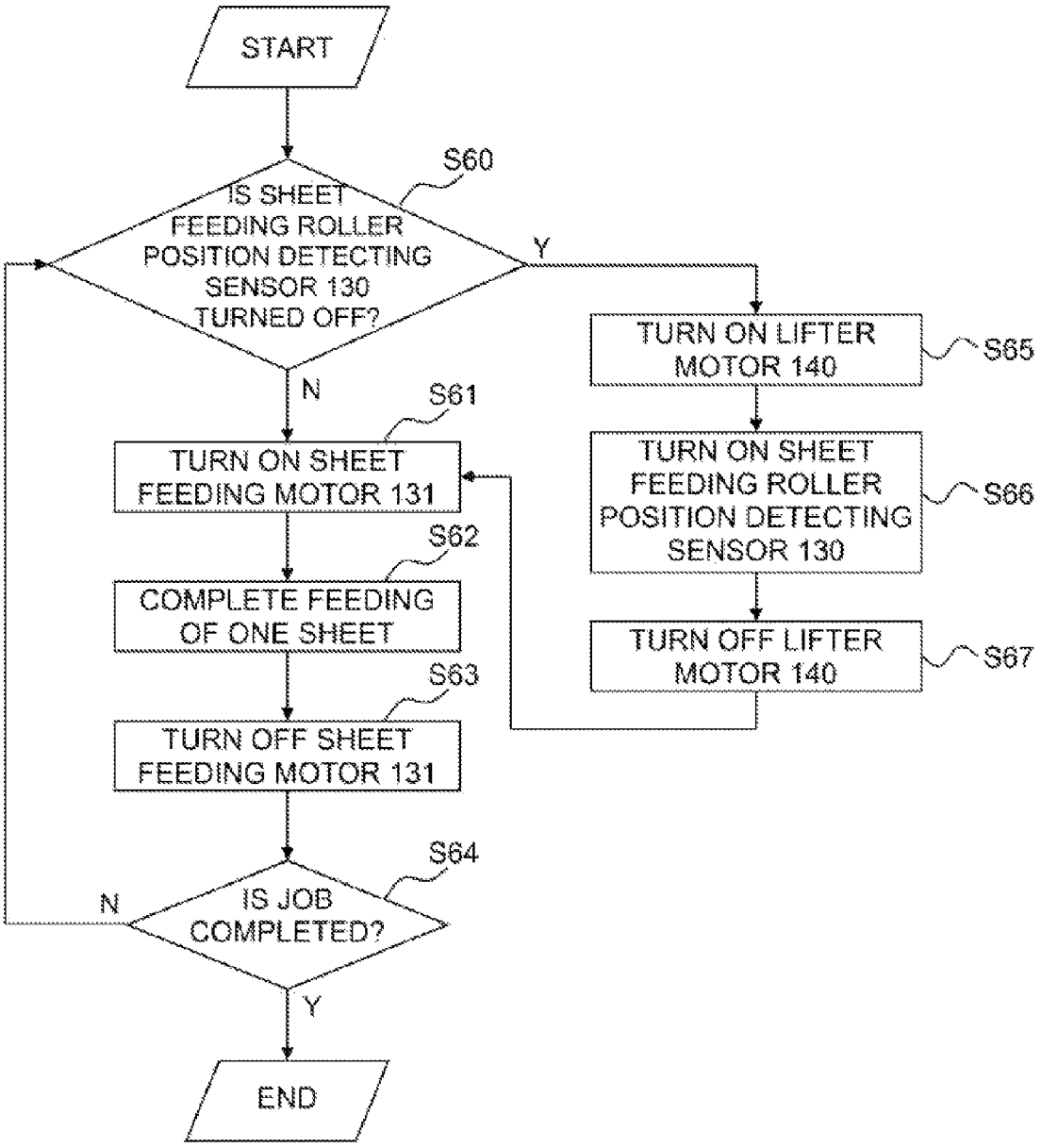
FIG. 6 is a flowchart which describes sheet feeding operation control of the sheet feeding apparatus and lift-up operation control during sheet feeding operation.

Next, sheet feeding operation control of the sheet feeding apparatus 71 and lift-up operation control during the sheet feeding operation will be described with reference to a flowchart of FIG. 6.

When a sheet feeding signal is received from an external PC (not illustrated) and the like after the initial lift-up operation is completed, the CPU 142 starts to drive the sheet feeding motor 131. Here, the driving force of the sheet feeding motor 131 is transmitted to the sheet feeding roller 101 via the sheet feeding roller shaft 101*a*, and the sheet feeding roller 101 is swung in a direction of arrow 101*c* in FIG. 2. Accordingly, sheets S are fed by the sheet feeding roller 101 and are conveyed subsequently to the separation nip 120 which is formed by the sheet feeding roller 101 and the separation roller 105. Then, the sheets S are separated and conveyed one by one approximately at the position of the separation nip 120 during passing through the separation nip 120. Subsequently, sheet feeding operation of one sheet is completed as being fed to the vertical conveying path 81 as described above.

At that time, in a case that the sheet feeding roller position detecting sensor 130 is not OFF ("No" in S60), that is, in a case that the sheet feeding roller position detecting sensor 130 is ON, the sheet feeding motor 131 is kept ON (S61) without driving the lifter motor 140. When feeding of one sheet is completed (S62), the sheet feeding motor 131 is turned off (S63). Subsequently, it is determined whether the JOB is completed (S64). When the JOB is not completed ("No" in S64), repetition of S60 to S64 is performed.

By the way, every time when feeding of one sheet is completed, the sheet face position of the uppermost sheet is lowered by the amount of one sheet. At that time, the sheet feeding roller 101 is lowered by the pressing force of the sheet feeding roller pressing spring 103, following to the sheet face position of the uppermost sheet. Further, as described above, since the spring force of the separation roller pressing spring 107 is set to be smaller than the spring force of the sheet feeding roller pressing spring 103, the separation roller 105 and the separation guide 106 are also lowered in position when the sheet feeding roller 101 is lowered.

Figure 7:
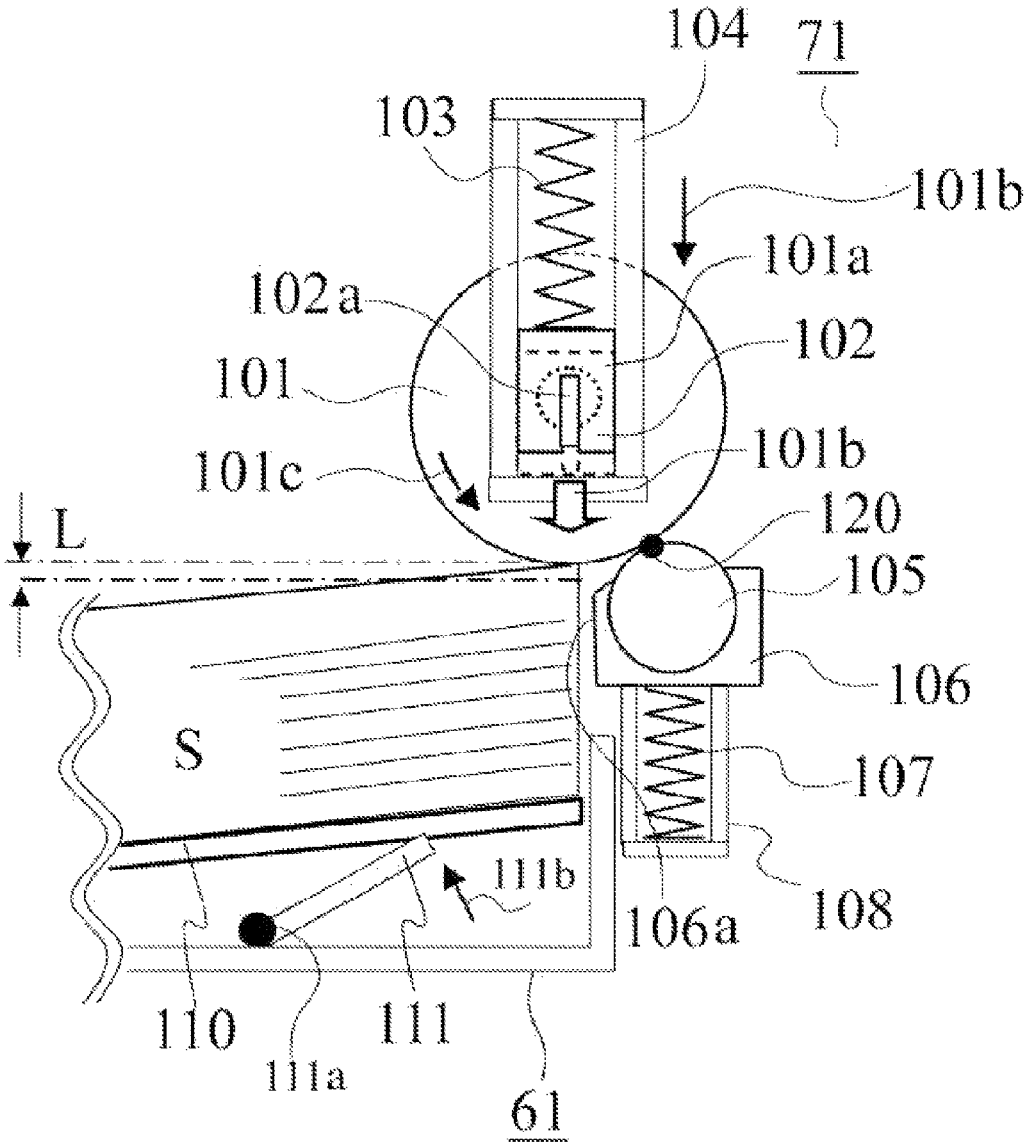
FIG. 7 is a view illustrating a state that the sheet feeding roller is lifted as being abutted to a sheet.

When the sheet feeding roller 101 is lowered to a position indicated by a broken line as being lowered by a distance L illustrated in FIG. 7, the sheet feeding roller position detecting sensor 130 is turned OFF. When the sheet feeding roller position detecting sensor 130 is turned OFF as described above ("Yes" in S60), the lifter motor 140 is to be driven (turned ON) (S65). Accordingly, the sheet supporting plate 110 is upwardly swung and the sheets S are lifted. Subsequently, the uppermost sheet S is abutted to the sheet feeding roller 101 and the sheet feeding roller 101 is lifted against the pressing force of the sheet feeding roller pressing spring 103.

Subsequently, when the sheet feeding roller position detecting sensor 130 is turned ON (S66) as detecting the position of the sheet feeding roller 101 lifted as described above, the driving of the lifter motor 140 is stopped after a predetermined period of time is passed (S67). With the above control, the upper face position of the uppermost sheet S stacked on the sheet supporting plate 110 during sheet feeding operation is maintained within a range of the distance L of FIG. 7.

By the way, with the structure in which the sheet feeding roller 101 is slidingly movable as being pressed by the sheet feeding roller pressing spring 103 as in the present embodiment, the pressing position between the sheet feeding roller 101 and the sheet S is varied in accordance with a sheet stacking state.

Figure 8A:
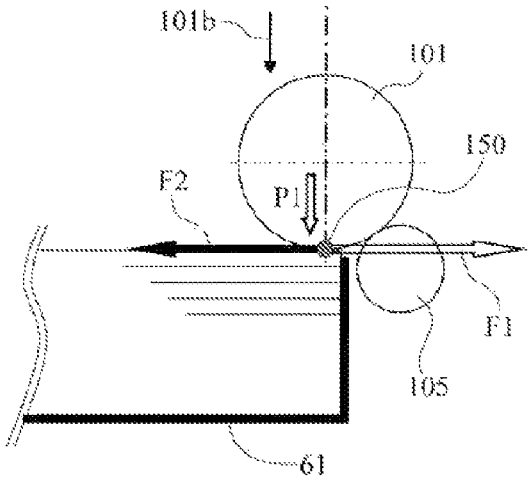
FIG. 8A is an explanatory view of relation between a sheet stacking state of the sheet feeding apparatus and a pressing position where the sheet feeding roller presses a sheet.

FIG. 8A illustrates a state when sheets S are fully stacked. At that time, the upper face of the sheets S has an angle of being horizontal. The pressing position 150 at which the sheet feeding roller 101 is abutted to the uppermost sheet is the lowermost point position of the sheet feeding roller 101, that is, the lower end position of the sheet feeding roller 101.

Figure 8B:
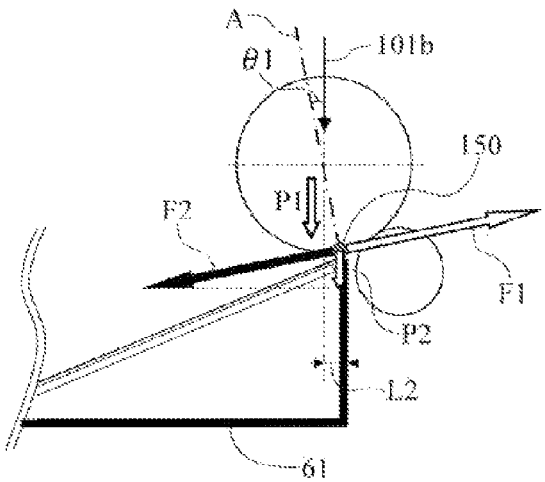
FIG. 8B is an explanatory view of relation between the sheet stacking state of the sheet feeding apparatus and a pressing position where the sheet feeding roller presses a sheet.

FIG. 8B illustrates a small-amount-stacked state in which a small number of sheets S are stacked. In such a small-amount-stacked state, the pressing position 150 of the sheet feeding roller 101 is at a top end part of the uppermost sheet. That is, the pressing position 150 in the small-amount-stacked state is at the downstream side in the sheet feeding direction compared to the pressing position 150 in the fully-stacked state. When the pressing position 150 is at the downstream side as described above, the sheet feeding roller 101 is pressed to a sheet S at a higher position compared to the pressing position 150 in the fully-stacked state.

Figure 8C:
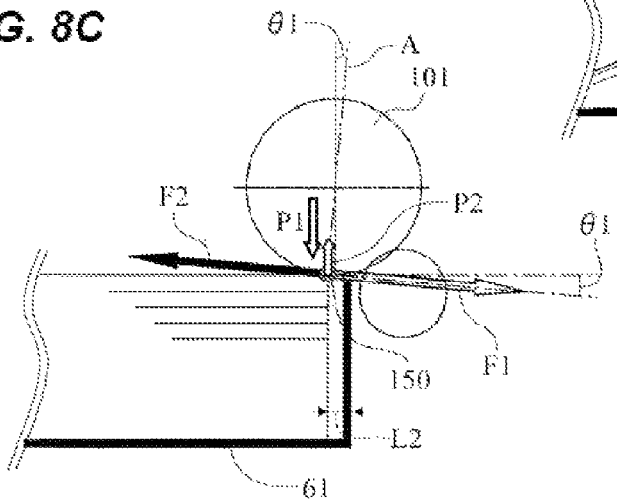
FIG. 8C is an explanatory view of relation between the sheet stacking state of the sheet feeding apparatus and a pressing position where the sheet feeding roller presses a sheet.

FIG. 8C illustrates a case that the pressing position 150 is at the upstreammost side. The pressing position 150 is shifted to the upstreammost side as described above when sheets S are located in the sheet feeding cassette 61 at the upstreammost side in the sheet feeding direction in the fully-stacked state. Normally, a sheet storage portion of the sheet feeding cassette 61 is required to be set longer than a sheet length to eliminate difficulty of putting sheets S into the sheet feeding cassette 61. How much longer the sheet storage portion should be is determined in consideration of variation of component dimensions of the sheet feeding cassette 61. In the present embodiment, the length of the sheet storage portion of the sheet feeding cassette 61 is set to generate clearance of 2 mm against a nominal sheet length.

Further, sheets have their own variation of length. Such length variation of sheets includes sheet cutting variation occurring at a cutting process during sheet manufacturing and expansion-contraction varied with a sheet moisture amount. The sheet length variation is estimated to be approximate +/−1 mm at maximum in total. Therefore, the clearance being 2 mm and the sheet length variation being approximate +/−1 mm at maximum generate top end position deviation being 3 mm at maximum.

When the sheet top end position deviation is at maximum as described above, the pressing position 150 is to be at the upstreammost position. In such a state, the pressing position 150 of the sheet feeding roller 101 is at the upstream side compared to the pressing position 150 in the fully-stacked state. When the pressing position 150 is in the upstream side as described above, the sheet feeding roller 101 is to be pressed to a sheet S at a higher position compared to the pressing position 150 in the fully-stacked state.

When a height position where the sheet feeding roller 101 is abutted to the sheet is varied in accordance with the variation of the pressing position 150 as described above, sheet feeding pressure of the sheet feeding roller 101 during sheet feeding is varied. When magnitude of the sheet feeding pressure exceeds a predetermined range, sheets cannot be stably fed with occurrence of double-feeding or non-feeding.

Therefore, in the present embodiment, to reduce such variation of the sheet feeding pressure due to the height position of the sheet feeding roller 101, a biasing direction of the sheet feeding roller 101 is set to a direction as illustrated in FIGS. 8B and 8C. That is, the biasing direction of the sheet feeding roller 101 is set between a normal line of the sheet feeding roller 101 at the pressing position 150 in the small-amount-stacked state as illustrated in FIG. 8B and a normal line of the sheet feeding roller 101 at the pressing position 150 as illustrated in FIG. 8C.

Next, the sheet feeding pressure corresponding to the sheet stacking state in a case that the biasing direction of the sheet feeding roller 101 is set as described above will be described in detail with reference to FIGS. 8A to 8C. In a case that the sheets S are in the fully-stacked state, a reaction force F2 having the same magnitude as a sheet feeding conveyance force F1 occurs at the pressing position 150 of the sheet feeding roller 101 and the sheet upper face when the sheet feeding roller 101 feeds a sheet as being rotated as illustrated in FIG. 8A. In such a fully-stacked state, the sheet supporting plate 110 is in a most downwardly-swung state.

Here, the reaction force F2 is expressed by P1×microl as the sheet feeding pressure and an inter-sheet friction force of the sheets S being denoted respectively by P1 and microl. In the present embodiment, when P1 is 2.5 N, test results show that microl is varied in a range between 0.3 and 0.8. Therefore, the reaction force F2 is varied in a range between 0.75 and 2.0 N. when the sheets S are in the fully-stacked state.

When the sheets S are in the small-amount-stacked state, there occurs an angle difference θ1 between the normal line (indicated by line A) of the sheet feeding roller 101 at the pressing position 150 and the biasing direction of the sheet feeding roller 101, as illustrated in FIG. 8B. A variation component P2 of the reaction force F2 against the sheet feeding pressure P1 is expressed by F2 sin θ1. Here, since the sheets S are set as being horizontal in the sheet fully-stacked state as illustrated in FIG. 8A and the pressing position 150 is to be at the lowermost point of the sheet feeding roller 101, the normal line direction A against the sheet feeding roller 101 is matched with the biasing direction 101*b* of the sheet feeding roller 101 and θ1 becomes to zero. Accordingly, P2 becomes to zero in the fully-stacked state, so that the sheet feeding pressure variation component is not generated.

In contrast, in the small-amount-stacked state as illustrated in FIG. 8B as the pressing position 150 being at the downstream side in the sheet feeding direction compared to the pressing position 150 in the fully-stacked state, θ1 does not become to zero owing to inclination of the normal line (indicated by line A) of the sheet feeding roller 101 at the pressing position 150. Here, a distance L2 between a sheet feeding roller center line and the sheet top end position when the pressing position 150 is at the downstreammost position is 2 mm and the diameter of the sheet feeding roller 101 is 32 mm. At that time, θ1 becomes to 11.5 degree. When the sheet supporting plate 110 is swung most upwardly, the pressing position 150 is to be at the downstreammost position as described above. Accordingly, the maximum value of the variation component P2 of the reaction force F2 against the sheet feeding pressure P1 occurs when F2 is 2.0 N. At that time, P2 becomes to approximate 0.4 N (=2.0 N×sin 11.5 degree). Further, the direction of the variation component P2 at that time is oriented downwardly in FIG. 8B to act in the direction to increase the sheet feeding pressure.

As illustrated in FIG. 8C, when the pressing position 150 is at the upstreammost position, the distance L2 between the sheet feeding roller center line and the sheet top end position becomes to 1 mm. At that time, since the normal line of the sheet feeding roller 101 at the pressing position 150 is inclined, θ1 becomes to 5.75 degree. The variation component P2 in this state is approximate 0.2 N (=2.0 N×sin 5.75 degree). Here, the direction of the variation component P2 at that time is oriented upwardly in FIG. 8C to act in the direction to decrease the sheet feeding pressure.

Thus, in the present embodiment, the biasing direction of the sheet feeding roller 101 is set between the normal line of the sheet feeding roller 101 at the downstreammost pressing position 150 and the normal line of the sheet feeding roller 101 at the upstreammost pressing position 150. Accordingly, the sheet feeding pressure variation due to the reaction force occurring during sheet feeding can be brought within a range between −0.2 and 0.4 N at maximum.

Figure 9:
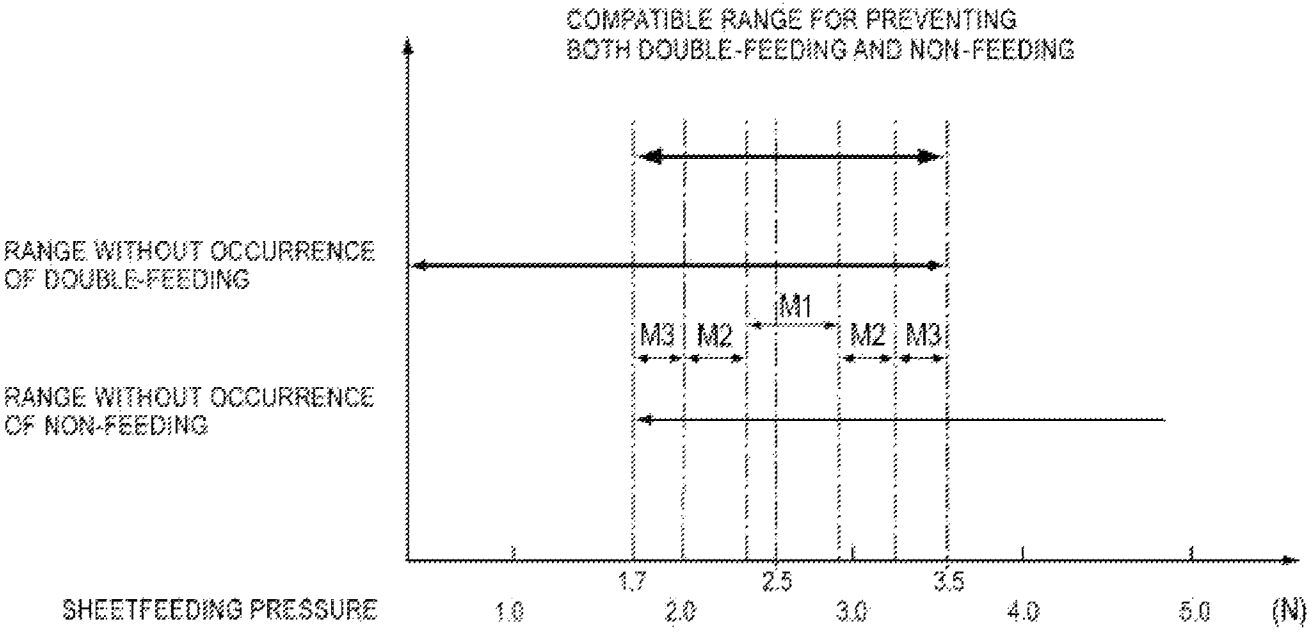
FIG. 9 is a view illustrating relation between variation of sheet feeding pressure and sheet feeding performance of the sheet feeding apparatus.

FIG. 9 illustrates relation between such sheet feeding pressure variation and sheet feeding performance. As is evident from FIG. 9, in a case that the sheet feeding pressure P1 is set to 2.5 N, double-feeding does not occur in a range where the sheet feeding pressure P1 is smaller than 3.5 N. Further, non-feeding does not occur in a range where the sheet feeding pressure P1 is larger than 1.7 N. Accordingly, in a case that the sheet feeding pressure P1 is set to 2.5 N as described above, excellent sheet feeding performance with occurrence of neither double-feeding nor non-feeding can be obtained when the sheet feeding pressure P1 is in a range between 1.7 and 3.5 N.

By the way, in addition to the sheet feeding pressure variation of −0.2 to 0.4 N occurring at sheet feeding (M1 in FIG. 9) as described above, factors of the sheet feeding pressure variation include sheet feeding pressure variation M2 occurring with height variation of the uppermost sheet. As described above, the height of the upper face of the uppermost sheet of the stacked sheets S is controlled to be maintained at a constant height. However, since variation occurs owing to component accuracy, sheet curling, and the like, the sheet feeding pressure variation occurs. In the present embodiment, this sheet feeding pressure variation is estimated to be +/−0.3 N (M2 in FIG. 9).

Accordingly, the sheet feeding pressure P1 is to be varied between −0.5 and 0.7 N having the nominal pressure of 2.5 N as the center owing to addition of the abovementioned sheet feeding pressure variation (M1 in FIG. 9) being −0.2 to 0.4 N and the sheet feeding pressure variation (M2 in FIG. 9) being +/−0.3 N. Provided that the sheet feeding pressure variations M1 and M2 are included, the sheet feeding pressure P1 in the present embodiment is to be in a range between 2.0 N (=2.5 N−0.5 N) and 3.2 N (=2.5 N+0.7 N). That is, a margin of +/−0.3 N can be ensured against the sheet feeding pressure of 1.7 to 3.5 N to be capable of performing excellent sheet feeding performance as illustrated in FIG. 8 for the sheet feeding pressure P1 in the present embodiment, even when the sheet feeding pressure variations M1 and M2 are included.

As described above, in the present embodiment, the sheet feeding roller 101 is supported as being linearly movable in the up-and-down direction and is applied a force in the direction to be pressed to the sheets stacked on the sheet supporting plate 110. Further, in the present embodiment, the biasing direction of the sheet feeding roller 101 is set between the normal line of the sheet feeding roller 101 at the downstreammost pressing position 150 and the normal line of the sheet feeding roller 101 at the upstreammost pressing position 150. With the above setting, sheet feeding pressure enabling to perform excellent sheet feeding performance can be obtained and occurrence of double-feeding and non-feeding can be prevented, so that sheets can be stably fed.

Figure 10:
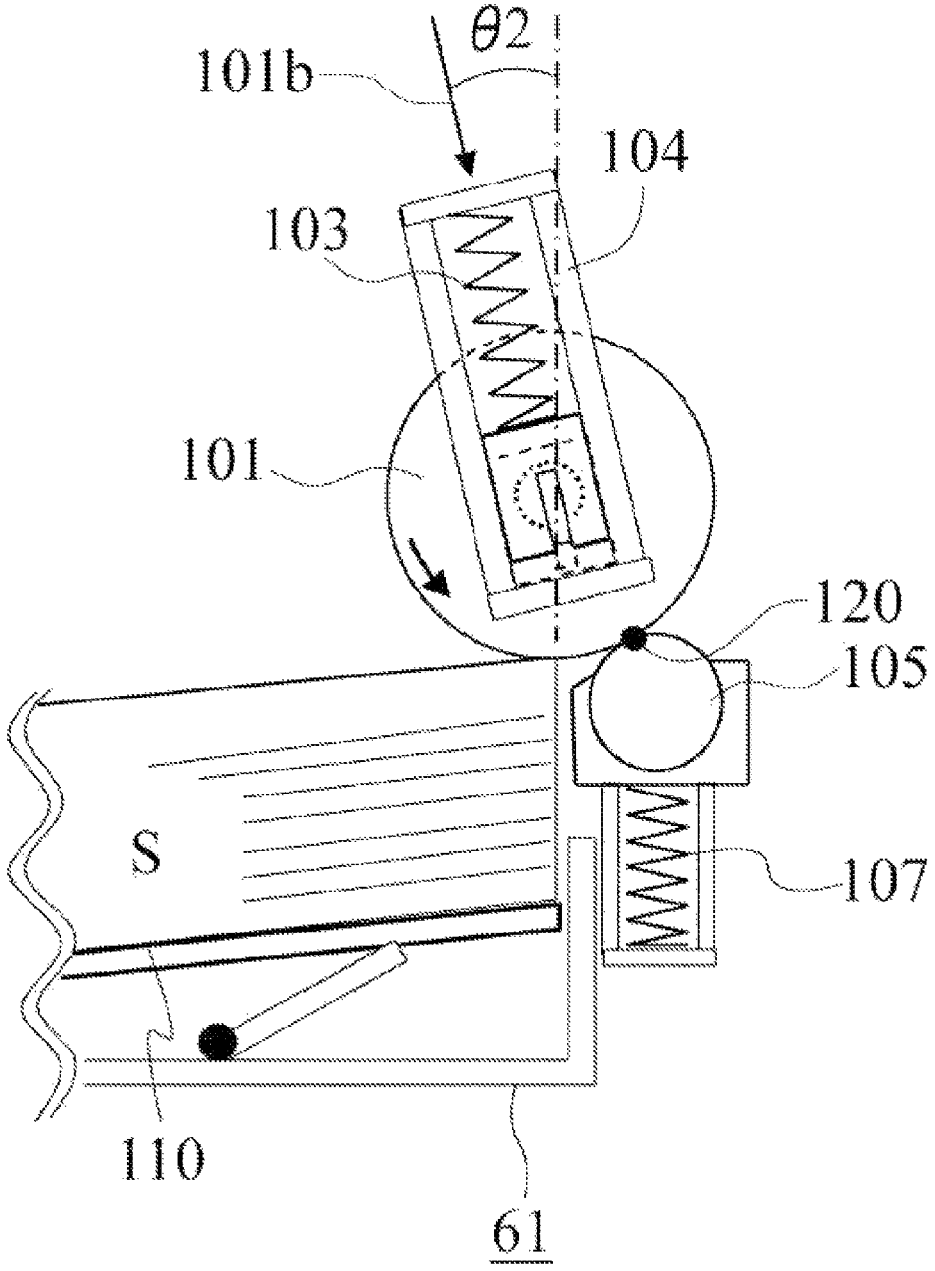
FIG. 10 is a view illustrating a structure of a sheet feeding apparatus according to a second embodiment of the present invention.

Next, a second embodiment of the present invention will be described. FIG. 10 is a view illustrating a structure of a sheet feeding apparatus according to the present embodiment. In FIG. 10, the same numerals as those in above-mentioned FIGS. 8A to 8C denote the same or corresponding components.

As illustrated in FIG. 10, the sheet feeding roller restricting guide 104 is inclined, and accordingly, the biasing direction 101*b* of the sheet feeding roller 101 is inclined by θ2 from the vertical direction. Here, θ2 is set to be 11.5 degree as being the same as θ1 of the case that the pressing position 150 is at the downstreammost position as in FIG. 8B described above. With the above structure, an angle difference θ3 between the biasing direction 101*b* and the normal line direction A of the sheet feeding roller 101 becomes to zero. Therefore, the variation component P2 of the reaction force F2 against the sheet feeding pressure P1 becomes to zero.

Figure 11A:
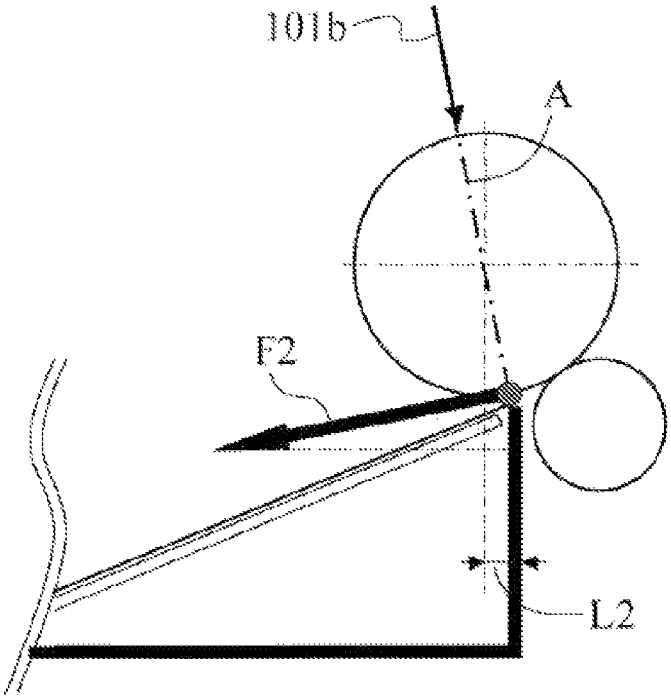
FIG. 11A is an explanatory view of relation between the sheet stacking state of the sheet feeding apparatus and a pressing position where the sheet feeding roller presses a sheet.
Figure 11B:
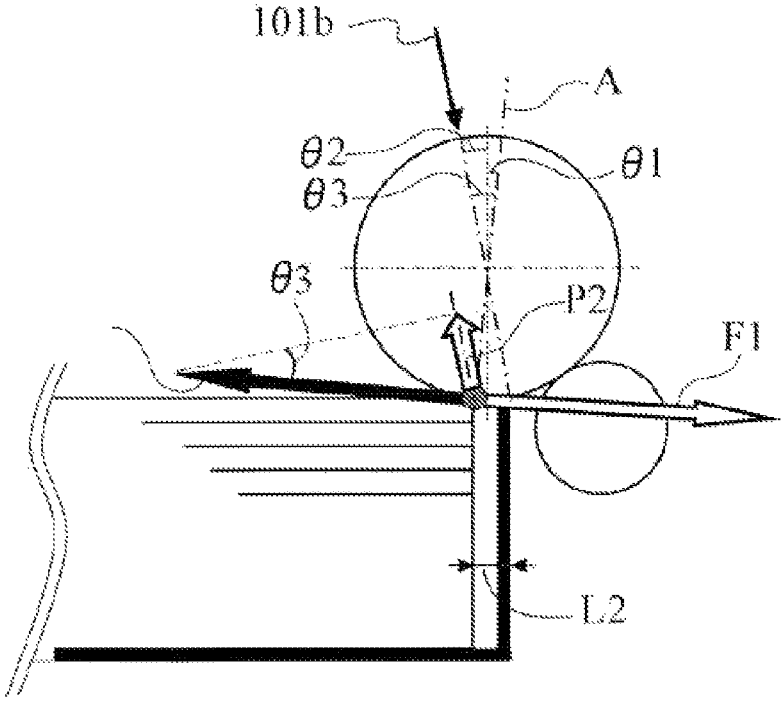
FIG. 11B is an explanatory view of relation between the sheet stacking state of the sheet feeding apparatus and a pressing position where the sheet feeding roller presses a sheet.

In contrast, as illustrated in FIG. 11B, when the pressing position 150 is at the upstreammost position, the angle difference θ3 between the biasing direction 101*b* and the normal line direction A of the reaction force F2 becomes to 17.25 degree as being a sum of the biasing direction 101*b* and θ1 (5.75 degree) in FIG. 8C described above. Accordingly, the variation component P2 of the reaction force F2 against the sheet feeding pressure P1 becomes to approximate 0.6 N (=0.2 N×sin 17.25 degree).

In a case that the biasing direction 101*b* is inclined as described above, the sheet feeding pressure variation due to reaction force occurring at the time of sheet feeding is between 0 and 0.6 N, and a width of the sheet feeding pressure variation is 0.6 N as being in the same level as in the first embodiment which is described above. Accordingly, the width of the sheet feeding pressure variation can be set to be similar to the first embodiment, so that the same level of feeding performance is obtained.

Figure 12:
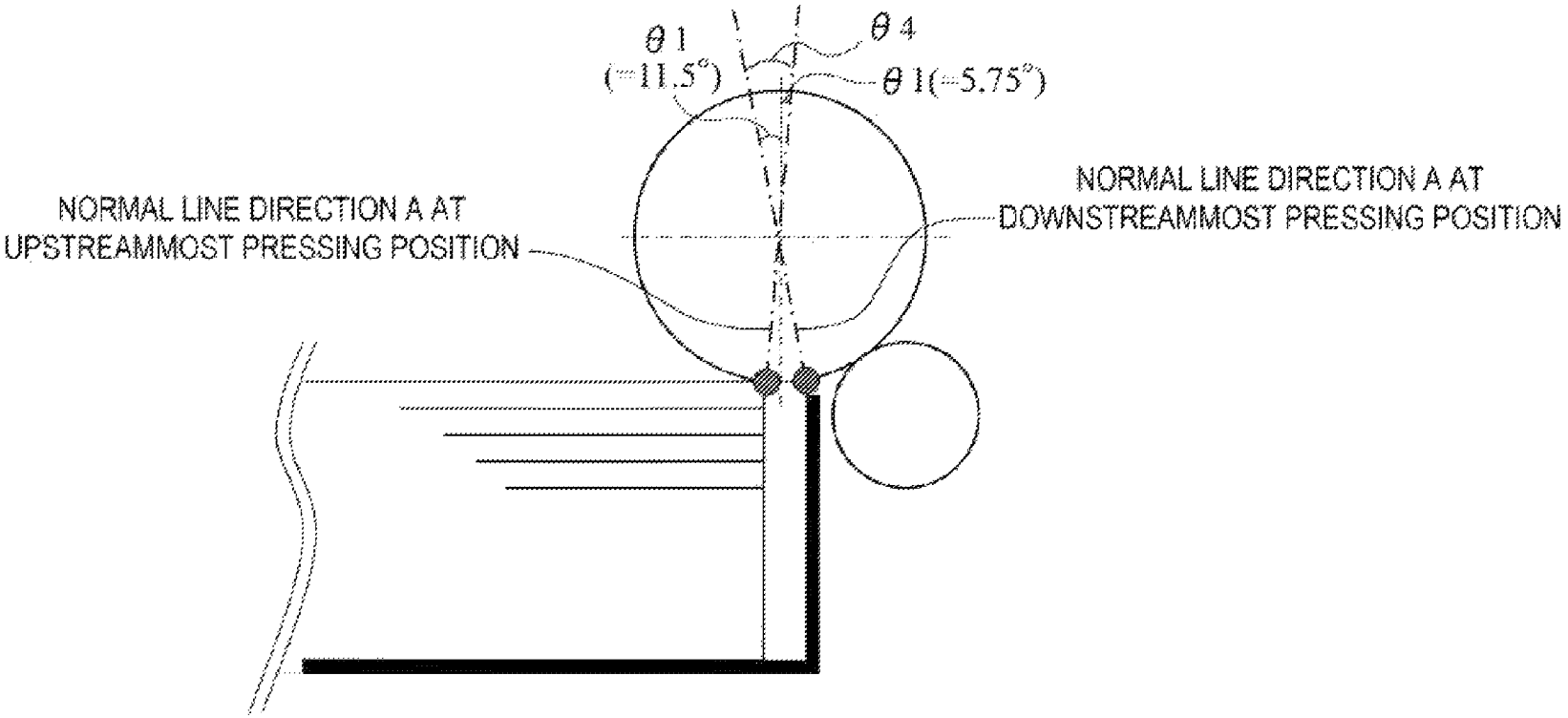
FIG. 12 is an explanatory view of a range of a biasing direction of the sheet feeding roller.

As described above, in a case that the biasing direction 101*b* of the sheet feeding roller 101 is inclined, the width of the sheet feeding pressure variation becomes to the minimum value when the biasing direction 101*b* of the sheet feeding roller 101 is within an angle range of the normal line direction A at the pressing position 150 against the sheet feeding roller 101. That is, an angle range θ4 of the normal line direction A as in FIG. 12 is an angle of a sum of θ1 when the pressing position 150 is at the downstreammost position and θ1 when the pressing position 150 is at the upstreammost position. In the present embodiment, θ4 is the angle range being 17.25 degree (=11.5 degree+5.75 degree).

The angle range θ4 is varied in accordance with a range of the pressing position 150. Here, the sheet feeding pressure variation width becomes to the minimum regardless of the angle range θ4 as long as the biasing direction 101*b* is set within the range of the normal direction A. In the above description, the biasing direction 101*b* of the sheet feeding roller 101 is matched with the normal line direction at the pressing position 150 in the fully-stacked state. However, the present invention is not limited thereto. Provided that the biasing direction 101*b* is set at an angle between the normal line direction at the downstreammost position and the normal line direction at the upstreammost position in the range of the pressing position 150, the width of the sheet feeding pressure

The invention claimed is:

1. A sheet feeding apparatus, comprising;

a sheet storage portion which includes a sheet stack tray being swingable in an up-and-down direction, wherein sheets are stacked on the sheet stack tray;

a feeding roller which is arranged above the sheet stack tray and which feeds an uppermost sheet stacked on the sheet stack tray;

a support portion which supports the feeding roller as being linearly movable in the up-and-down direction;

a lifting mechanism which lifts the sheet stack tray;

a sheet detecting portion which detects a height of an uppermost sheet stacked on the sheet stack tray, wherein the lifting mechanism is controlled based on a detection signal from the sheet detecting portion so as to lift the sheet stack tray;

a roller biasing member which applies a force to the feeding roller in a direction of pressing to the sheet stacked on the sheet stack tray; and a separation member which is pressed against the sheet feeding roller to form a separation portion with the sheet feeding roller that separates the sheets one by one, wherein when that the feeding roller presses to contact with the sheets stacked in the sheet storage portion, the sheet portion is disposed so as that a downstream end of the sheets in a sheet conveyance direction positions near a lowest point of the feeding roller, and a biasing direction of the roller biasing member is configured so that a contacting and pressing position between the sheet and a peripheral surface of the feeding roller changes between both an upstream side and downstream side for the lowest point of the feeding roller in the sheet conveyance direction according to a stacking amount of the sheets stacked in the sheet storage portion.

2. The sheet feeding apparatus according to claim 1, wherein a biasing direction of the feeding roller due to the roller biasing member at a pressing position where the feeding roller is pressed to the sheet is set within a range between a normal line of the feeding roller at an upstream-most pressing position against a sheet feeding direction and a normal line of the feeding roller at a downstream-most pressing position against the sheet feeding direction out of the pressing positions varying in accordance with a sheet stacking state.

3. The sheet feeding apparatus according to claim 2, wherein the upstream-most pressing position in the sheet feeding direction is a position where the feeding roller is pressed to a sheet when sheets in a fully-stacked state are located at the upstream-most side of the sheet storage portion in the sheet feeding direction; and the downstream-most pressing position in the sheet feeding direction is a position where the feeding roller is pressed to a sheet when the sheet stack tray is swung most upwardly.

4. The sheet feeding apparatus according to claim 1, wherein the lifting mechanism lifts the sheet stack tray so that the sheet is pressed to the feeding roller at predetermined pressure.

5. The sheet feeding apparatus according to claim 4, wherein the sheet detecting portion includes a sensor portion and a sensor lever; and the sensor lever is moved in synchronization with the feeding roller.

6. An image forming apparatus which includes a sheet feeding apparatus, and an image forming portion which forms an image on a sheet fed from the sheet feeding apparatus, the sheet feeding apparatus comprising:

a sheet storage portion which includes the sheet stack tray being swingable in an up-and-down direction, wherein sheets are stacked on the sheet stack tray;

a feeding roller which is arranged above the sheet stack tray and which feeds an uppermost sheet stacked on the sheet stack tray;

a support portion which supports the feeding roller as being linearly movable in the up-and-down direction;

a lifting mechanism which lifts the sheet stack tray;

a sheet detecting portion which detects a height of an uppermost sheet stacked on the sheet stack tray, wherein the lifting mechanism is controlled based on a detection signal from the sheet detecting portion so as to lift the sheet stack tray;

a roller biasing member which applies a force to the feeding roller in a direction of pressing the feeding roller to the sheet stacked on the sheet stack tray lifted by the lifting mechanism; and a separation member which is pressed against the sheet feeding roller to form a separation portion with the sheet feeding roller that separates the sheets in to single sheet, wherein when that the feeding roller presses to contact with the sheets stacked in the sheet storage portion, the sheet portion is disposed so as that a downstream end of the sheets in a sheet conveyance direction positions near a lowest point of the feeding roller, and a biasing direction of the roller biasing member is configured so that a contacting and pressing position between the sheet and a peripheral surface of the feeding roller changes between both an upstream side and downstream side for the lowest point of the feeding roller in the sheet conveyance direction according to a stacking amount of the sheets stacked in the sheet storage portion.

7. The image forming apparatus according to claim 6, wherein a biasing direction of the feeding roller due to the roller biasing member at a pressing position where the feeding roller is pressed to the sheet is set within a range between a normal line of the feeding roller at an upstream-most pressing position against a sheet feeding direction and a normal line of the feeding roller at a downstream-most pressing position against the sheet feeding direction out of the pressing positions varying in accordance with a sheet stacking state.

8. The image forming apparatus according to claim 7, wherein the upstream-most pressing position in the sheet feeding direction is a position where the feeding roller is pressed to a sheet when sheets in a fully-stacked state are located at the upstream-most side of the sheet storage portion in the sheet feeding direction; and the downstream-most pressing position in the sheet feeding direction is a position where the feeding roller is pressed to a sheet when the sheet stack tray is swung most upwardly.

9. The image forming apparatus according to claim 6, the sheet feeding apparatus wherein the lifting mechanism lifts the sheet stack tray is lifted so that the sheet is pressed to the feeding roller at predetermined pressure.

10. The image forming apparatus according to claim 9, wherein the sheet detecting portion includes a sensor portion and a sensor lever; and the sensor lever is moved in synchronization with the feeding roller.

* * * * *